US010367322B2

(12) United States Patent
Chen

(10) Patent No.: US 10,367,322 B2
(45) Date of Patent: Jul. 30, 2019

(54) HARD DISK DATA INTERFACE PITCH CONVERTER

(71) Applicant: Jiangsu Lewinsh Electronic Technology Co., Ltd, Kunshan (CN)

(72) Inventor: Gengfa Chen, Pingxiang (CN)

(73) Assignee: JIANGSU LEWINSH ELECTRONIC TECHNOLOGY CO., LTD, Kunshan (CN)

( * ) Notice: Subject to any disclaimer, the term of this patent is extended or adjusted under 35 U.S.C. 154(b) by 186 days.

(21) Appl. No.: 15/328,161

(22) PCT Filed: Apr. 25, 2016

(86) PCT No.: PCT/CN2016/080101
§ 371 (c)(1),
(2) Date: Jan. 23, 2017

(87) PCT Pub. No.: WO2017/185197
PCT Pub. Date: Nov. 2, 2017

(65) Prior Publication Data

US 2019/0173248 A1 Jun. 6, 2019

(51) Int. Cl.

| | |
|---|---|
| ***H01R 3/00*** | (2006.01) |
| ***H01R 31/08*** | (2006.01) |
| ***H01R 12/70*** | (2011.01) |
| ***H01R 13/52*** | (2006.01) |
| ***H01R 12/55*** | (2011.01) |
| ***H01R 31/06*** | (2006.01) |
| ***H01R 12/79*** | (2011.01) |

(52) U.S. Cl.
CPC ..... *H01R 31/085* (2013.01); *H01R 12/55* (2013.01); *H01R 12/7082* (2013.01); *H01R 12/79* (2013.01); *H01R 13/52* (2013.01); *H01R 31/06* (2013.01)

(58) Field of Classification Search
CPC .. H01R 31/085; H01R 12/7082; H01R 13/52; H01R 31/06; H01R 12/79; G05B 19/056; E02F 3/304; G03F 7/0754
USPC ..... 439/495
See application file for complete search history.

(56) References Cited

U.S. PATENT DOCUMENTS 8,558,304 B2 * 10/2013 Chen ..... G03F 7/0754 257/314
2008/0282583 A1 * 11/2008 Koellner ..... E02F 3/304 37/348
2009/0083522 A1 * 3/2009 Boggs ..... G05B 19/056 712/220

* cited by examiner

*Primary Examiner* — Jean F Duverne
(74) *Attorney, Agent, or Firm* — CBM Patent Consulting, LLC

(57) ABSTRACT

A hard disk data interface pitch converter is disclosed, which comprises: a converting part, comprising converting terminals and contact terminals, the converting terminals comprising metallic conductors having a relatively large interval at one end and a relatively small interval at the other end; a short connection part for connecting any two or more non-adjacent metallic conductors in the contact terminals through metallic conductors; a base with a channel for accommodating the contact terminals and a slot for fixing the short connection part; a cover body cooperating with the base for protecting the converting part and short connection part. An extension part is formed by digging each metallic conductor in the contact terminals, and exactly shields a gap between the contact terminals and channel. The short connection part enables miniaturization of a device. It is possible to prevent adhesives or foreign objects from falling onto contacting ends of the contact terminals.

9 Claims, 6 Drawing Sheets

HARD DISK DATA INTERFACE PITCH CONVERTER

This application is the U.S. national phase of International Application No. PCT/CN2016/080101 Filed on 25 Apr. 2016 which designated the U.S. the entire contents of each of which are hereby incorporated by reference.

TECHNICAL FIELD

The present disclosure relates to a connector, and particularly to a hard disk data interface pitch converter.

BACKGROUND

Some existing connectors have been standardized, while some connectors need to be customized individually. The standardized connector and the customized connectors have different pitches between terminals. To realize connection between the standardized connector and the customized connectors, electric wiring soldering or a printed circuit board is generally applied to realize pitch conversion. This kind of conversion is not only complicated in structure, but also high in cost and low in efficiency of production and assembly.

SUMMARY

In view of drawbacks in the prior art, the present disclosure provides a hard disk data interface pitch converter.

For realizing the above objects, the present disclosure provides the following technical solutions.

A hard disk data interface pitch converter comprises:

a converting part, which comprises converting terminals and contact terminals, wherein the contact terminals comprise a plurality of metallic conductors which are independent from one another, the converting terminals comprise metallic conductors which have a relatively large interval at one end and a relatively small interval at the other end, and the end of the converting terminals where the metallic conductors have the large interval between is connected in a one-to-one manner to an end of the metallic conductors in the contact terminals;

a short connection part, which is operable to connect any two or more non-adjacent metallic conductors in the contact terminals through metallic conductors;

a base, which is provided with a channel for accommodating the contact terminals and a slot for fixing the short connection part; and a cover body, which cooperates with the base for protecting the converting part and the short connection part, wherein an extension part is formed by digging each of the metallic conductors in the contact terminals, and the extension part exactly shields a gap between the contact terminals and the channel.

Preferably, in the hard disk data interface pitch converter, the base is provided with raised blocks to be hot melt for fixing the converting terminals, and the raised blocks are arranged alternately between the converting terminals.

Preferably, in the hard disk data interface pitch converter, the raised blocks are provided with a first guiding angle at the top, and the raised blocks have a height which is 0.5-2 times larger than an interval between the raised blocks.

Preferably, in the hard disk data interface pitch converter, the converting terminals and contact terminals are formed into an integral part or are connected by soldering.

Preferably, in the hard disk data interface pitch converter, the base is provided with stop holes at both ends, the cover body is provided with stop columns corresponding to the stop holes.

Preferably, in the hard disk data interface pitch converter, each of the stop columns is provided with a stop block at the bottom and a second guiding angle at the top, and the stop columns have a cross section identical with that of the stop holes.

Preferably, in the hard disk data interface pitch converter, the cover body is provided with a first hook at one side and a first groove at the other side, the base is provided with a second groove at one side which cooperates with the first hook and a second hook at the other side which cooperates with the first groove, and the first hook is arranged at a different side from the stop block.

Preferably, in the hard disk data interface pitch converter, the cover body is provided with a check block for protecting the converting terminals.

Preferably, in the hard disk data interface pitch converter, the cover body is provided with flat cable holes through which flat cables pass.

The present disclosure has the following beneficial effects.

(1) In the present disclosure, flexible conversion of pitch can be realized, and a large pitch can be converted into a small pitch.

(2) In the present disclosure, the short connection part is provided, so that any two or more circuits can be flexibly connected without redesigning the converting terminals. The short connection part can further realize miniaturization of a device.

(3) The extension part is formed by digging the metallic conductors of the contact terminals. The extension part can prevent adhesives or foreign objects from falling onto contacting ends of the contact terminals, thus avoiding short circuit. In addition, the extension part by itself is a portion of the metallic conductors, so that it can be formed during forming the metallic conductors by pressing, which saves procedures and decreases cost.

(4) The raised blocks are arranged on the base. When the raised blocks are hot melt, they exactly fix metallic conductors of the converting terminals, to prevent the metallic conductors from warping up. The raised blocks are provided with a guiding angle at the top, so that when the raised blocks are hot melt, it is ensured that the melt adhesive uniformly spreads to both sides and covers a surface of metallic conductors of the converting terminals. In addition, the raised blocks provide guiding for metallic conductors during assembling, so that the metallic conductors smoothly enter regions between two raised blocks, thus improving assembling efficiency. By setting a size of the raised blocks precisely, the amount of adhesives from the melt raised blocks can exactly cover and fix the metallic conductors, and neither adhesive overflowing nor adhesive breaking occurs.

(5) The stop columns and stop blocks are provided with a guiding angle, so that the cover body can be easily guided into stop holes during assembling, and the base and the cover body are connected firmly by stop blocks.

(6) The cover body is provided with a hook at one side and a groove at the other side. In this design, the cover body tilts to a certain angle during assembling to realize pre-fixing at one side, which facilitates snap-fitting of the hook at the other side. In this way, the assembling efficiency is improved, plastic parts like hooks are less prone to damage, and the yield is high.

DETAILED DESCRIPTION OF EMBODIMENTS

Figure 1:
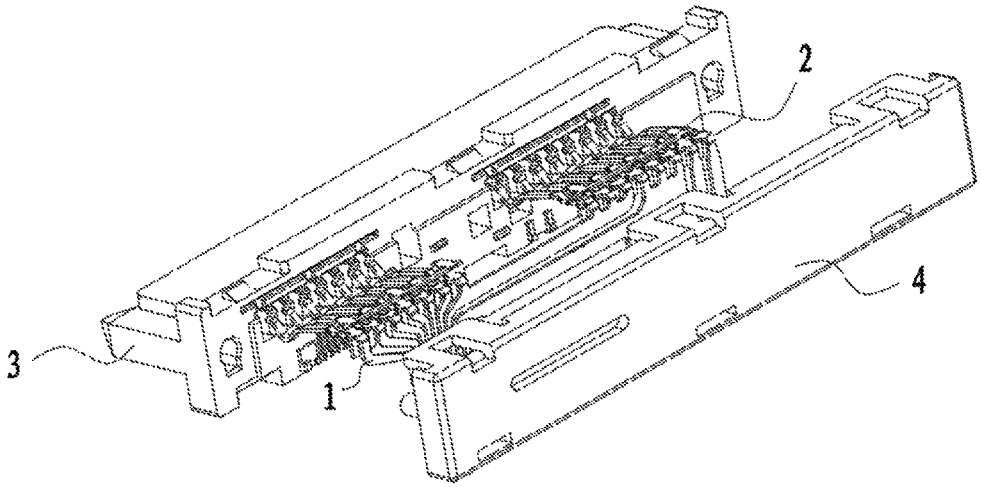
FIG. 1 is an exploded view illustrating a hard disk data interface pitch converter.

This and other aspects of the present disclosure will now be described in more detail, with reference to the appended drawings showing a currently preferred embodiment of the invention.

As shown in FIGS. 1-9, an embodiment of the present disclosure provides a hard disk data interface pitch converter which comprising a converting part 1. The converting part 1 comprises converting terminals 5 and contact terminals 6. The contact terminals 6 comprise a plurality of metallic conductors which are independent from one another. The converting terminals 5 comprise a plurality of metallic conductors, and are arranged in such a manner that the plurality of metallic conductors have a relatively large interval at one end and a relatively small interval at the other end for realizing pitch conversion. In this way, a large pitch is converted into a small pitch, so that the cost of product is reduced. The end of the converting terminals 5 with a large interval between metallic conductors is connected in a one-to-one manner to an end of the metallic conductors in the contact terminals 6.

The hard disk data interface pitch converter further comprises a short connection part 2. The short connection part 2 connects any two or more non-adjacent metallic conductors in the contact terminals 6 through metallic conductors. It is noted that, the short connection part 2 are not only used for connecting non-adjacent metallic conductors, but also for connecting two neighboring conductors. However, if it is necessary to connect two neighboring metallic conductors, there is no need for the short connection part 2, since two neighboring metallic conductors in the converting terminals 5 can be directly connected with each other. This also leads to no occupation in volume. Therefore, in the present disclosure, the short connection part 2 mainly functions to connect non-adjacent metallic conductors.

The hard disk data interface pitch converter further comprises a base 3. The base 3 is provided with a channel 7 for accommodating the contact terminals 6 and a slot for fixing the short connection part 2.

The hard disk data interface pitch converter further comprises a cover body 4, which cooperates with the base 3 for protecting the converting part 1 and the short connection part 2.

An extension part 9 is formed by digging each of the metallic conductors of the contact terminals 6. The extension part 9 exactly shields a gap between contact terminals 6 and the channel 7. In the prior art, an additional blocking piece is provided to at the gap. In this case, not only a piece (i.e., the blocking piece) is added, but also a set of procedure is added, which increases the production cost. In the present disclosure, the extension part 9 is formed from the metallic conductors themselves by digging. The extension part 9 functions to prevent dust, foreign objects, and adhesives. Further, the gap is shielded once the converting part 1 is assembled, which not only makes full use of the raw material, but also saves a procedure.

In another embodiment of the present disclosure, the base 3 is provided with raised blocks 10 to be hot melt for fixing the converting terminals 5. The raised blocks 10 are arranged alternately between the converting terminals 5. The raised blocks 10 by themselves are made from a hot melting type plastic. When the raised blocks are hot pressed, they soften and flow to a surface of the converting terminals 5. After cooling, the raised blocks firmly fix the converting terminals 5 to the base 3. The raised blocks 10 can prevent metallic conductors in the converting terminals 5 from being short circuited.

In a further embodiment of the present disclosure, the raised blocks 10 are provided with a first guiding angle 11 at the top, and have a height which is 0.5-2 times larger than an interval between the raised blocks 10. The first guiding angle 11 functions in such a manner that when the raised blocks 10 are melt by hot pressing, the melt plastic adhesive uniformly spreads to both sides and covers the surface of metallic conductors of the converting terminals 5. A ratio between the height of the raised blocks 10 and the interval between the raised blocks 10 is controlled precisely, so that an adhesive content in the raised portion of the raised blocks 10 is defined. In this way, it is ensured that the amount of adhesives from the melt raised blocks can exactly cover and fix the metallic conductors, without adhesive overflowing and adhesive breaking.

Figure 2:
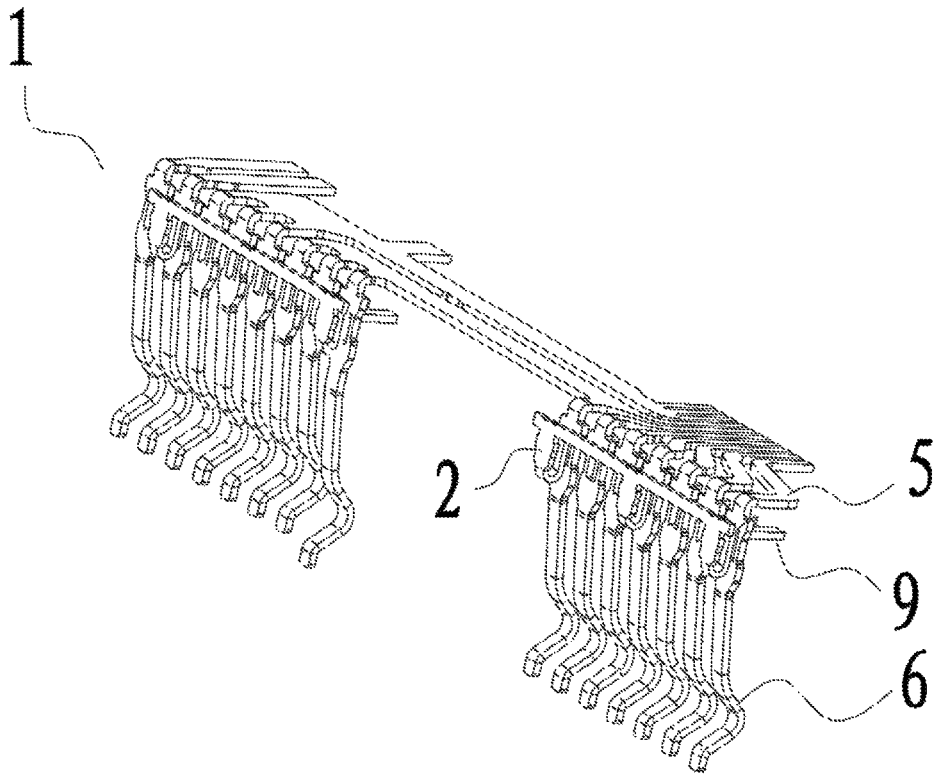
FIG. 2 is a structural view illustrating a converting part 1 in a hard disk data interface pitch converter.
Figure 3:
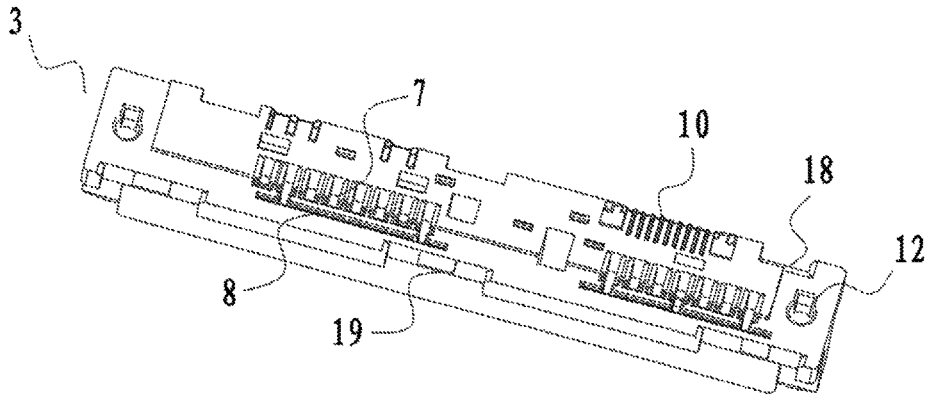
FIG. 3 is a structural view illustrating a base 3 in a hard disk data interface pitch converter.
Figure 4:
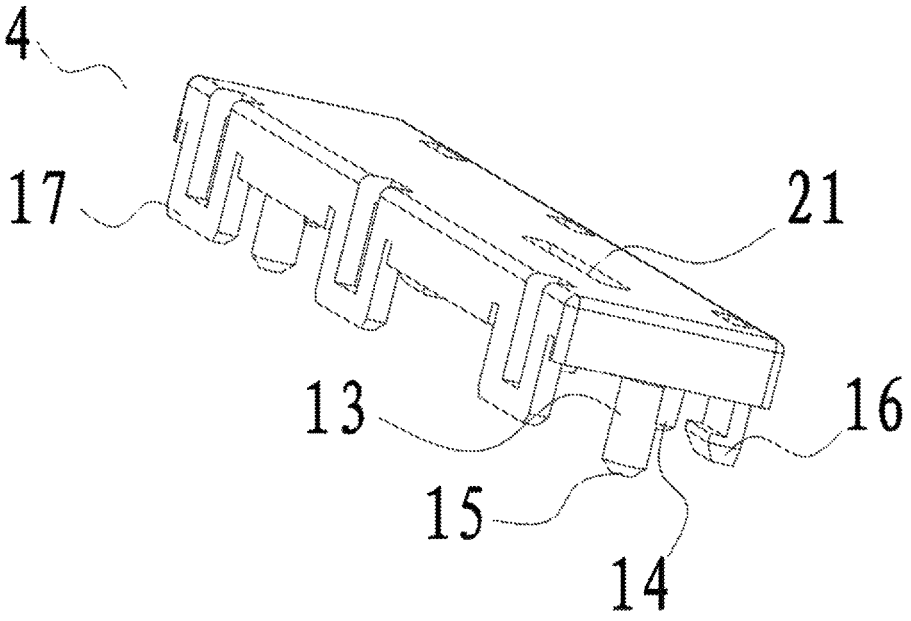
FIG. 4 is a structural view illustrating a cover body 4 in a hard disk data interface pitch converter.
Figure 5:
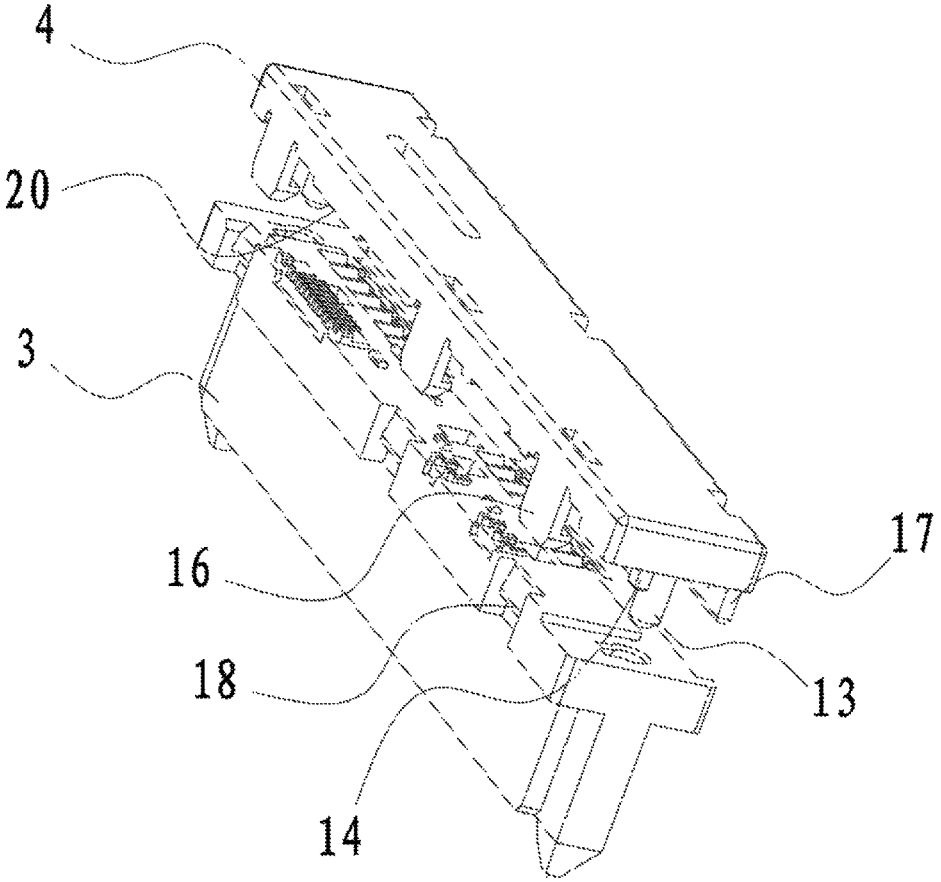
FIG. 5 is a structural view illustrating a base 3 and a cover body 4 in a hard disk data interface pitch converter in a covered state.
Figure 6:
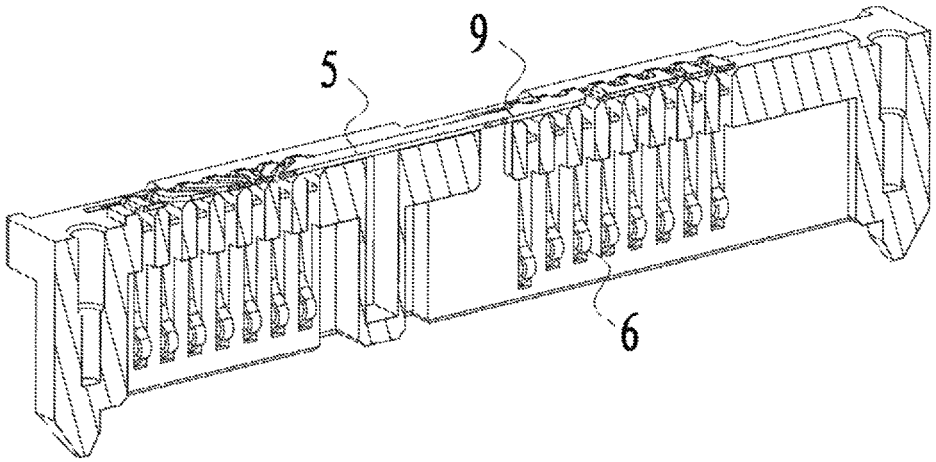
FIG. 6 is a cross-sectional view illustrating a hard disk data interface pitch converter (not including a cover body 4).
Figure 7:
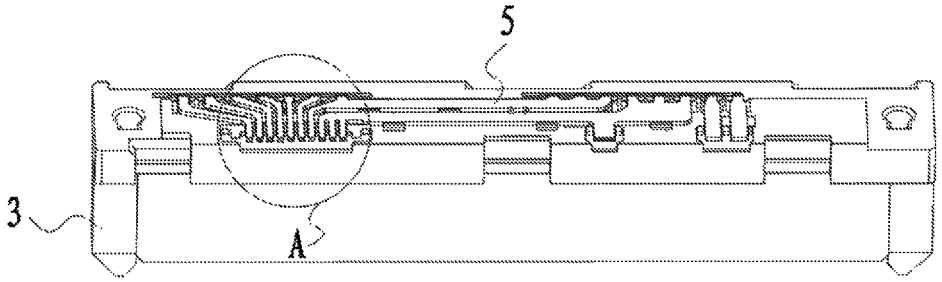
FIG. 7 is a structural view illustrating a hard disk data interface pitch converter not including a cover body 4.
Figure 8:
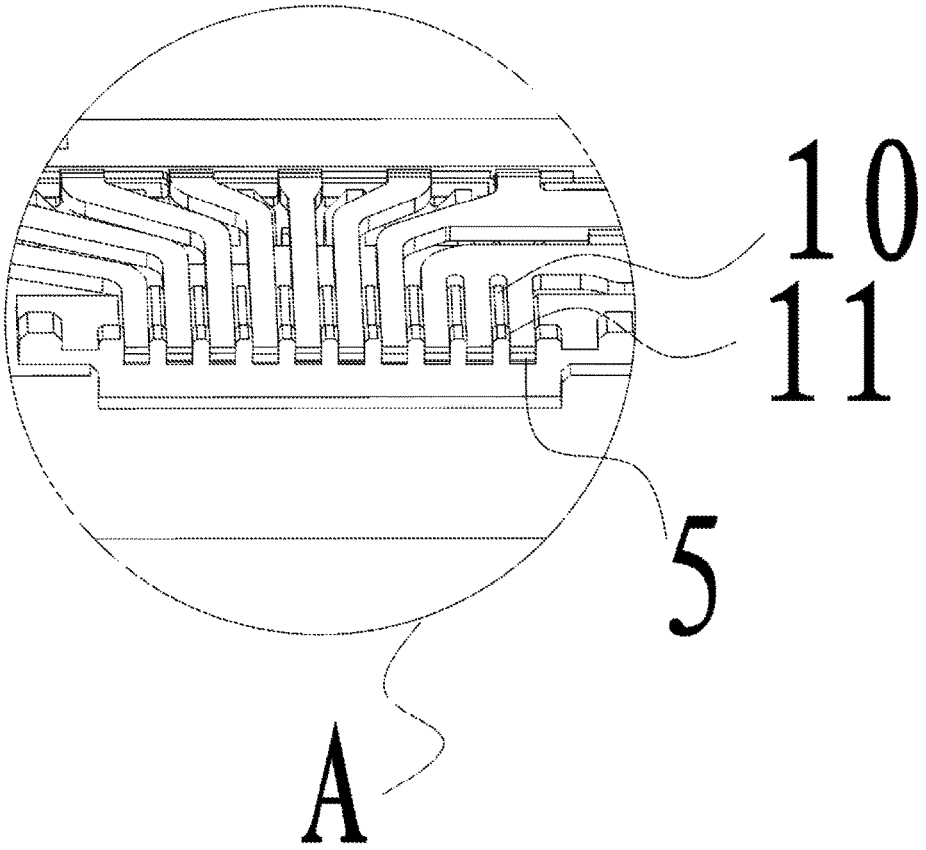
FIG. 8 is an enlarged view illustrating A in FIG. 7.
Figure 9:
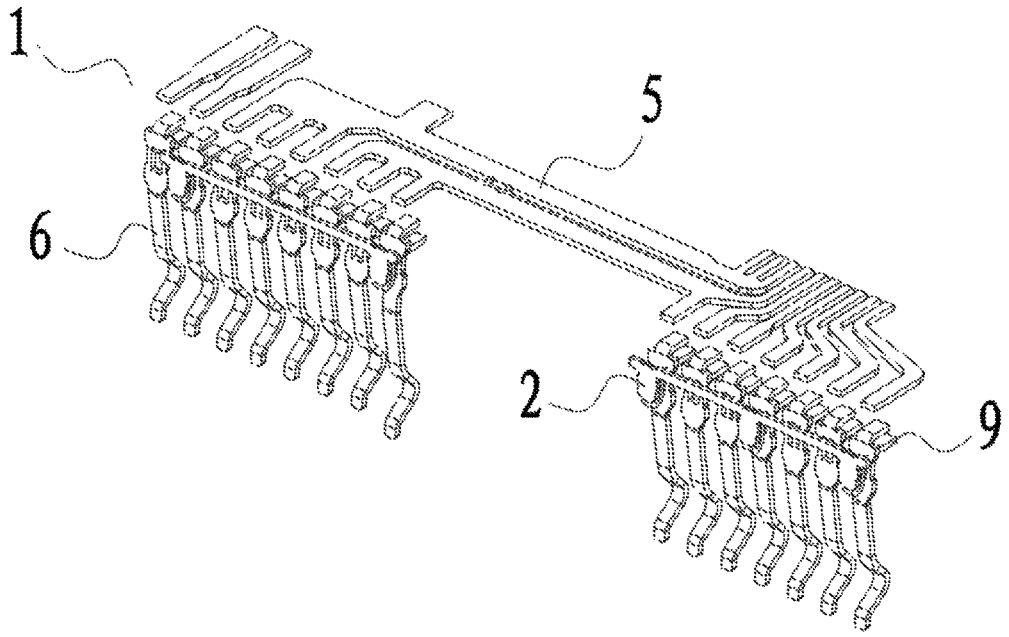
FIG. 9 is a structural view illustrating converting terminals 5 and contact terminals 6 in a split type.

In a further embodiment of the present disclosure, preferably, the converting terminals 5 and the contact terminals 6 can be formed into an integral part (as shown in FIG. 2) or can be connected by soldering, i.e., of a split type construction (as shown in FIG. 9).

In a further embodiment of the present disclosure, the base 3 is provided with stop holes 12 at both ends, and the cover body 4 is provided with stop columns 13 corresponding to the stop holes 12.

In a further embodiment of the present disclosure, each of the stop columns 13 is provided with a stop block 14 at the bottom and a second guiding angle 15 at the top. The stop columns 13 have a cross section identical with that of the stop holes 12. The second guiding angle 15 functions to provide guiding during assembling, so that the top of the stop columns 13 easily enter the stop holes 12 and then are stopped by the stop block 14.

In a further embodiment of the present disclosure, the cover body is provided with a first hook 16 at one side and a first groove 17 at the other side, the base is provided with a second groove 18 at one side which cooperates with the first hook 16 and a second hook 19 on the other side which cooperates with the first groove 17. The first hook 16 and the stop block 14 are arranged at a same side. In this design, during assembling, the first groove 17 and the second hook 19 snap-fit firstly, the cover body 4 and the base 3 form an inclined angle which helps the stop columns 13 to be guided into the stop holes 12, and the first hook 16 and the second groove 18 snap-fit finally. This assembling manner is more fast than a manner in which the cover body 4 and the base 3 snap-fit in a straight up and down way. Besides, in this assembling manner, a small force is asserted on the hook, so that small and precise parts like hooks are less prone to damage. Therefore, this assembling manner not only increases the efficiency of assembling, but also decreases the defective percentage of the final product.

In a further embodiment of the present disclosure, the cover body is provided with a check block 20 for protecting the converting terminals. The check block 20 mainly functions to prevent dust and foreign objects.

In a further embodiment of the present disclosure, the cover body is provided with flat cable holes 21 through which flat cables pass.

The hard disk data interface pitch converter are produced by steps of stamping forming a raw material, injection molding, electroplating, assembling, inspection, packaging, and shipment.

The above are merely embodiments of the present disclosure. It should be appreciated that, a person skilled in the art may make further improvements and modifications without departing from the principle of the present disclosure, and these improvements and modifications shall also fall within the scope of the present disclosure.

What is claimed is:

1. A hard disk data interface pitch converter, comprising:

a converting part, which comprises converting terminals and contact terminals, wherein the contact terminals comprise a plurality of metallic conductors which are independent from one another, the converting terminals comprise metallic conductors which have a relatively large interval at one end and a relatively small interval at the other end, and the end of the converting terminals where the metallic conductors have the large interval between is connected in a one-to-one manner to an end of the metallic conductors in the contact terminals;

a short connection part, which is operable to connect any two or more non-adjacent metallic conductors in the contact terminals through metallic conductors;

a base, which is provided with a channel for accommodating the contact terminals and a slot for fixing the short connection part; and a cover body, which cooperates with the base for protecting the converting part and the short connection part, wherein an extension part is formed by digging each of the metallic conductors in the contact terminals, and the extension part exactly shields a gap between the contact terminals and the channel.

2. The hard disk data interface pitch converter of claim 1, wherein the base is provided with raised blocks to be hot melt for fixing the converting terminals, and the raised blocks are arranged alternately between the converting terminals.

3. The hard disk data interface pitch converter of claim 2, wherein the raised blocks are provided with a first guiding angle at the top, and the raised blocks have a height which is 0.5-2 times larger than an interval between the raised blocks.

4. The hard disk data interface pitch converter of claim 1, wherein the converting terminals and contact terminals are formed into an integral part or are connected by soldering.

5. The hard disk data interface pitch converter of claim 1, wherein the base is provided with stop holes at both ends, the cover body is provided with stop columns corresponding to the stop holes.

6. The hard disk data interface pitch converter of claim 5, wherein each of the stop columns is provided with a stop block at the bottom and a second guiding angle at the top, and the stop columns have a cross section identical with that of the stop holes.

7. The hard disk data interface pitch converter of claim 6, wherein the cover body is provided with a first hook at one side and a first groove at the other side, the base is provided with a second groove at one side which cooperates with the first hook and a second hook at the other side which cooperates with the first groove, and the first hook is arranged at a different side from the stop block.

8. The hard disk data interface pitch converter of claim 1, wherein the cover body is provided with a check block for protecting the converting terminals.

9. The hard disk data interface pitch converter of claim 1, wherein the cover body is provided with flat cable holes through which flat cables pass.

* * * * *